US006318117B1

(12) United States Patent
Jandal et al.

(10) Patent No.: US 6,318,117 B1
(45) Date of Patent: Nov. 20, 2001

(54) ABSORPTION CHILLER WITH COUNTER FLOW GENERATOR

(75) Inventors: Daoud A. Jandal, La Crosse; Lee L. Sibik, Onalaska; Robin R. Lee, La Crosse; Michael P. Morse, West Salem, all of WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/643,809

(22) Filed: Aug. 22, 2000

(51) Int. Cl.[7] ..... F25B 33/00
(52) U.S. Cl. ..... 62/497
(58) Field of Search ..... 62/497

(56) References Cited

U.S. PATENT DOCUMENTS 4,315,411 * 2/1982 Vardi et al. ..... 62/112
4,343,159 * 8/1982 Vardi et al. ..... 62/475
5,253,523 * 10/1993 Bernardin ..... 62/476
5,271,246 * 12/1993 Yamauchi ..... 62/476
5,477,696 * 12/1995 Takahata et al. ..... 62/148
5,636,526 * 6/1997 Plzak et al. ..... 62/475
6,050,083 * 4/2000 Meckler ..... 60/39.182
6,055,821 * 5/2000 Song et al. ..... 62/195
6,098,420 * 8/2000 Furukawa et al. ..... 62/484
6,192,694 * 2/2001 Hiro et al. ..... 62/141

* cited by examiner

*Primary Examiner*—William Doerrler
*Assistant Examiner*—Mark S. Shulman
(74) *Attorney, Agent, or Firm*—William J. Beres; William O'Driscoll

(57) ABSTRACT

A generator for an absorption chiller boils an absorption solution with steam heat by conveying the steam through a tube bundle with the steam flowing counter to the flow of solution. The tube bundle runs downhill in the direction of steam flow, while in some embodiments of the invention a bottom surface of the generator runs uphill in the direction of solution flow. The amount of solution in the generator is kept to an appropriately low level by submerging the tube bundle deeper at one end of the generator than the other.

18 Claims, 2 Drawing Sheets

ABSORPTION CHILLER WITH COUNTER FLOW GENERATOR

BACKGROUND OF THE INVENTION

1. Field of the Invention

The present invention relates to a generator of an absorption cooling system. More particularly, the present invention relates to the fluid flow pattern through the generator.

2. Description of Related Art

Typical absorption chillers have a refrigerant or working fluid consisting of at least a two-part solution, such as a solution of lithium bromide and water, or ammonia and water. Varying the solution's concentration by cyclical separation and absorption of the solution's two components allows the use of a pump, rather than a compressor, to circulate the solution through the chiller to create a cooling effect. A pump circulating a liquid solution generally requires less electrical energy or work input than other refrigerant cycles that use a compressor for compressing and circulating a comparable amount of gaseous refrigerant. However, for a given cooling effect, absorption chillers generally require more thermal energy input than other refrigerant systems that rely on compression and expansion of gaseous refrigerant. Thus, absorption chillers are often used where the savings in electrical energy out weighs the cost of the added thermal energy input.

An absorption chiller's generator uses much of the thermal energy input for separating the two components of the two-part solution. Often, a generator includes a heat exchanger in the form of coils, pipes or tubes through which steam is conveyed. For a lithium bromide and water solution, steam heat vaporizes the water out of solution, thereby leaving behind a liquid solution having a higher concentration of lithium bromide. Pressurized water vapor created by the generator then condenses upon entering an adjacent condenser. The condensed water, still pressurized, then passes through a flow restriction, which causes the water to expand to a much cooler, lower pressure water vapor. The relatively cool water vapor can then pass across a heat exchanger to cool a second fluid. The second fluid can then be used as needed, such as to cool a comfort zone of a building. The cool water vapor is subsequently reabsorbed by the higher concentrated liquid solution from the generator. This creates a solution of intermediate concentration, which is pumped back to the generator to complete the cycle.

In designing a generator for an absorption chiller, several factors need be considered. For example, lithium bromide and other absorption solutions can be expensive, thus it is often desirable to minimize the total amount of the solution in the chiller. One way to do this is to reduce the amount of the solution in the generator. However, insufficient solution in the generator can reduce a generator's efficiency, due to less heat transfer area. Insufficient solution can also create "hot spots" or areas where the steam coils of the generator rapidly heat a relatively small portion of solution. This can cause rapid, localized boiling of the solution, which can create a problem known as carryover.

Carryover is a generally undesirable effect where vaporous water entrains concentrated liquid lithium bromide solution from within the generator, and then carries the liquid over into the condenser. In some cases, evenly distributing the steam heat to the solution by increasing the liquid level of the solution in the generator can help reduce carryover. Of course, such an approach to solving the carryover problem unfortunately increases the total amount of solution in the generator.

Another problem often associated with steam-heated generators is a phenomenon known as water hammer. Water hammer is when the tubes or pipes that convey the steam through the generator produce a banging or hammering sound, due to superheated steam flash-heating condensate within the pipes. The resulting rapid expansion of the condensate causes a shockwave that creates the hammering noise. If the temperature of the steam is reduced in an attempt to avoid water hammer, the rate of heat transfer from the steam to the solution may be reduced as well. Yet, raising the temperature of the steam to reduce the amount of condensate within the steam pipes can reduce the efficiency of the generator.

Consequently, a need exists for a more efficient absorption generator that minimizes carryover, water hammer, and the e amount of solution in the generator.

SUMMARY OF THE INVENTION

It is an object of the present invention to provide an absorption chiller with a generator that conveys an absorption solution and a heat emitting fluid in a counter flow relationship to enhance heat transfer between the two and to provide other benefits.

Another object of the invention is to provide a generator that conveys steam downhill through a tube to minimize water hammer.

Another object is to place a heat emitting tube parallel to a bottom surface of a generator and tilt both the tube and the bottom surface to reduce water hammer and to simplify the construction of the generator.

Yet another object of the invention is minimize the amount of solution in a generator of an absorption chiller by varying the depth to which a heat emitting tube is submerged in the solution.

A further object of the invention is to vary the depth to which a heat emitting tube is submerged in an absorption solution of a generator to help reduce liquid carryover from the generator to a condenser.

A still further object of the invention is to provide a horizontally elongated generator that supplies a condenser with a vapor by evenly releasing the vapor across a broad area extending between opposite ends of the generator, whereby the broad, even dispersion of vapor helps reduce liquid carryover from the generator to the condenser.

Another object of the invention is to evenly distribute heat to a solution in an absorption generator by heating the solution with a tube bundle as opposed to a single tube, thereby minimizing liquid carryover from the generator to the condenser, which can be caused by violent boiling due to localized heating of the solution.

Yet another object is to enhance the heat transfer between an absorption solution and a fluid that heats the solution by conveying the solution and the heat emitting fluid in a counter flow relationship.

These and other objects of the present invention, which will better be appreciated when the following description of the preferred embodiment and attached drawing figures are considered, are accomplished in a horizontally elongated generator of an absorption chiller, wherein a heat emitting fluid and an absorption solution are conveyed through the generator in a counter flow relationship.

DESCRIPTION OF THE PREFERRED EMBODIMENT

Figure 1:
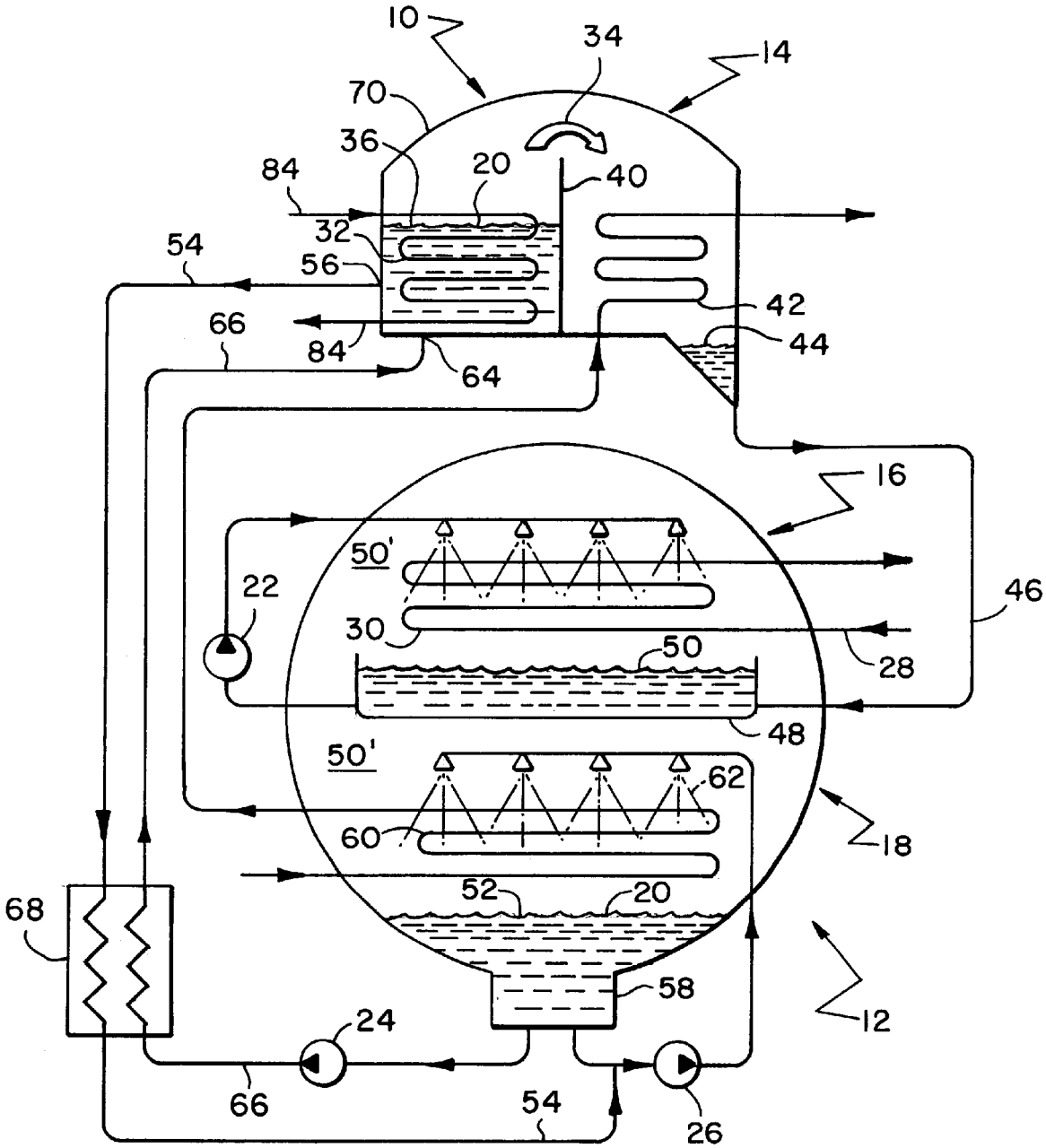
FIG. 1 is a schematic end view of an absorption chiller that includes a counter flow generator according to the present invention.
Figure 2:
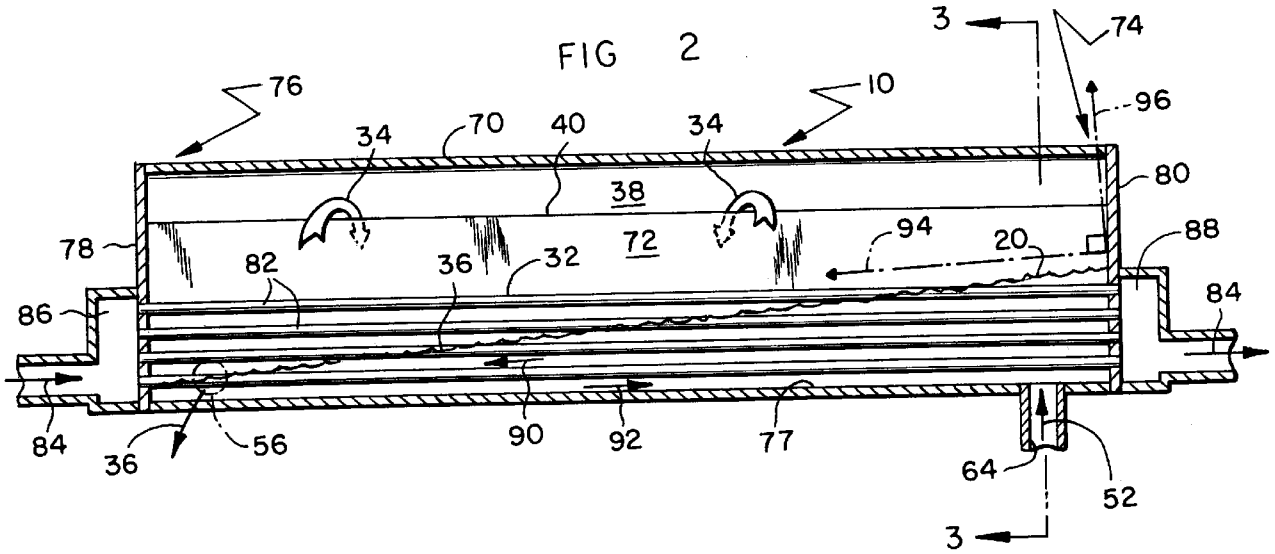
FIG. 2 is a cross-sectional side view of a counter flow generator taken along line 2—2 of FIG. 3.
Figure 3:
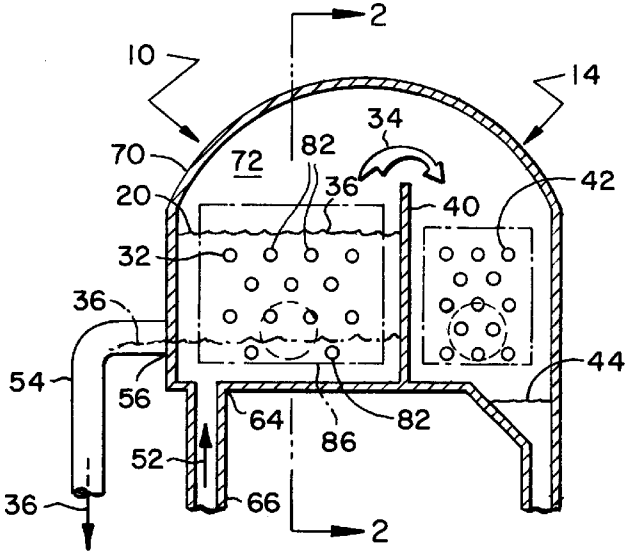
FIG. 3 is a cross-sectional end view of a counter flow generator taken along line 3—3 of FIG. 2.

Referring to FIG. 1, a generator 10 of the present invention is shown schematically to illustrate its relationship with other components of an exemplary absorption chiller 12. However, it should be appreciated by those skilled in the art that generator 10 is readily adapted for use in a variety of other absorption chillers. Further structural and functional details of generator 10 are shown in FIGS. 2 and 3.

In addition to generator 10, other major components of chiller 12 include a condenser 14, an evaporator 16 and an absorber 18. Chiller 12 also includes an absorption solution 20, which is any solution having at least one constituent that can be separated from and reabsorbed into a second constituent. Chiller 12 will be described with reference to solution 20 consisting of water and lithium bromide; however, other solutions, such as ammonia and water, are also well within the scope of the invention.

Various pumps 22, 24 and 26 circulate solution 20 through the various components of chiller 12 for the main purpose of chilling water 28. Water 28 is chilled upon passing through a heat exchanger 30 disposed in evaporator 16. Chilled water 28, which can actually be pure water, glycol, a mixture of water and glycol, or various other fluids, can be conveyed to wherever chilled water 28 may be needed. For example, chilled water 28 can be circulated through another heat exchanger (not shown) for cooling a room or area within a building. The process of chilling water 28 will now be explained with a description of the various components of chiller 12, starting with generator 10.

Generator 10 includes a heat exchanger 32 that boils solution 20 to create a lower concentrated fluid vapor 34 (primarily water) and a higher concentrated fluid 36 (liquid water with a high concentration of lithium bromide). Water vapor 34 passes through a vapor outlet 38 over a dividing wall 40 to be condensed by a cooling coil 42 in condenser 14. Condensed water 44, still pressurized (e.g., 1 psia) from the boiling in generator 10, further cools by expansion upon passing through a line 46 before discharging into a reservoir 48 in evaporator 16, which is at a lower pressure (e.g., 0.13 psia). Pump 22 draws cool water 50 from reservoir 48 and sprays water 50 over heat exchanger 30 for cooling water 28.

For solution 20 to reabsorb water vapor 50', pump 26 sprays an intermediate solution 62 (an intermediate concentration of solution 20) through an atmosphere of relatively pure water vapor 50'. This occurs in absorber 18. Pump 26 receives intermediate solution 62 as a mixture of concentrated solution 36 and a dilute solution 52. Concentrated solution 36 comes from a line 54 leading from an outlet 56 of generator 12 and dilute solution 52 comes from a sump 58 at the bottom of absorber 18. A cooling coil 60 in absorber 18 helps condense the mixture of water vapor 50' and intermediate solution 62, which collects in sump 58.

Typically, a source of water external to chiller 12 supplies cooling coils 42 and 60 with moderately cool water (e.g., 85 to 100 degrees Fahrenheit).

Once water vapor 50' is reabsorbed into solution 62 to create dilute solution 52, pump 24 delivers dilute solution 52 back to an inlet 64 of generator 10 via line 66 to complete the cycle. Often, a heat exchanger 68 can improve the overall efficiency of chiller 12 by using solution 36 in line 54 to heat solution 52 in line 66, thus preheating solution 52 before it enters generator 10.

To enhance the operation of generator 10, its structure addresses several design considerations, such as heat transfer efficiency, the amount of solution 20 in generator 10, liquid carryover over wall 40, and water hammer. Generator 10 includes an outer shell 70 defining a horizontally elongated generator chamber 72 that generally extends between an upstream end 74 and a downstream end 76. The terms, "upstream" and "downstream" refer to the general flow direction of liquid solution 20 through generator 10. Upstream end 74 and downstream end 76 are not necessarily the extreme ends of generator 10. Also, the term, "horizontally elongated" simply refers to being longer horizontally than vertically, and thus should not be construed as being limited to only those structures that are exactly or even substantially horizontal.

Generator chamber 72 is further defined by a bottom surface 77, wall 40, and two end plates, such as tube sheets 78 and 80. Tube sheets 78 and 80 attach to shell 70 at ends 76 and 74 respectively. Tube sheets 78 and 80 have a matrix of holes through which several heat exchanger tubes 82 extend. Tubes 82 convey steam 84, or some other heat emitting fluid, from a common fluid inlet chamber 86 at downstream end 76 to a common fluid outlet chamber 88 at upstream end 74. Steam 84 is typically supplied to tubes 82 by a source external to chiller 12. Upon flowing through tubes 82, steam 84 boils solution 20.

To enhance the heat transfer between steam 84 and solution 20, steam 84 and solution 20 travel through chamber 72 in a counter flow relationship. Liquid solution 20 flows by gravity assist generally in a first direction 90 from inlet 64 at upstream end 74 to outlet 56 at downstream end 76. Steam 84 flows in a counter flow direction 92 relative to the first direction 90 of liquid solution 20. The term, "counter flow" refers to relative flow paths whose flow directions or vectors point or diverge more than ninety degrees away from each other. A counter flow arrangement ensures an appreciable temperature differential between steam 84 and solution 20 along a substantial length of tubes 82. As the temperature of steam 84 decreases upon approaching upstream end 74, the steam continues to encounter liquid solution 20 of a lower temperature.

Ensuring effective heat transfer over a substantial length of tubes 82, avoids "hot spots" or areas of localized violent boiling of solution 20. Evenly distributing the boiling of solution 20 over the length of generator chamber 72 helps reduce the amount of liquid solution 20 entrained by vapor 34. Thus, this reduces the amount of liquid that vapor 34 carries over wall 40 and into condenser 14.

To minimize a water hammer effect, tubes 82 preferably run downhill to ensure proper drainage of steam condensate from within tubes 82. In other words, steam 84 travels slightly downward upon moving from downstream end 76 to upstream end 74 of generator 10. This downward incline is best seen in FIG. 2 upon comparing the orientation of tubes 82 relative to a horizontal line 94.

On the other hand, the liquid level of solution 20 in generator 10 is at an incline in an opposite direction to that of tubes 82. This is apparent upon comparing the liquid level of solution 20 to horizontal line 94. The incline of the liquid level is due to gravity assisting the flow of liquid solution 20 from upstream end 74 to downstream end 76. The inclined liquid level and rather low elevation of outlet 56 helps keep the amount of liquid solution 20 in generator 10 to an appropriately low level.

Although tubes 82 can be submerged more deeply at upstream end 74 than at downstream end 76, effective heat transfer can still occur, even where portions of tubes 82 are not submerged. This is because heat transfer occurs when the boiling action causes solution 20 to bubble up onto those tubes that are not submerged.

To simplify the manufacturing of generator 10, tubes 82 are installed perpendicular to tube sheets 78 and 80, which in turn are perpendicular to bottom surface 76 of shell 70. This simplifies the fixturing and drilling of tube sheets 78 and 80, as well as simplifies the fixturing and fabrication of shell 70. To achieve the proper incline of tubes 82, the entire generator 10 is disposed at a slight angle (e.g., 1 degree or even less). Thus, surface 77 runs uphill from upstream end 74 to downstream end 76, and tube sheets 78 and 80 lean at an angle to a vertical line 96, as shown in FIG. 2.

Although the invention is described with reference to a preferred embodiment, it should be appreciated by those skilled in the art that other variations are well within the scope of the invention. For example, generator 10 can serve a single-stage absorption chiller, as just described, or multi-stage chillers. Also, the various components of chiller 10 can be rearranged in a variety other configurations. For example, generator 10 and condenser 14 can share a common shell 70, as shown in FIG. 3, or they may be contained in individual shells. Likewise, shell 70 can adjoin the shell that contains evaporator 16 and absorber 18, or the shells can be separate. Cooling coil 42 of condenser 14 can be of a tube and shell design having a tube bundle similar to that of generator 10, as shown in FIG. 3, or can be of another heat exchanger design. Although outlet 56 is illustrated as a simple discharge pipe, in some embodiments of the invention, outlet 56 is actually a weir that spills into a discharge chamber adjacent outlet 56. Therefore, the scope of the invention is to be determined by reference to the claims, which follow.

We claim:

1. An absorption generator that heats a liquid solution with a heat emitting fluid, comprising:

a generator chamber being horizontally elongated and extending between an upstream end and a downstream end, and being adapted to convey said liquid solution in a first direction from said upstream end to said downstream end; and a tube adapted to convey said heat emitting fluid from said downstream end to said upstream end to place said heat emitting fluid in heat exchange relationship with said solution, wherein said tube is more deeply submerged in said liquid solution at said upstream end than at said downstream end.

2. The absorption generator of claim 1, wherein gravity assists said generator chamber in conveying said liquid solution therethrough.

3. The absorption generator of claim 1, wherein said generator chamber includes an inclined bottom surface that is higher at said downstream end than at said upstream end.

4. The absorption generator of claim 1, wherein said tube is disposed at an incline with said tube being higher at said downstream end than at said upstream end.

5. The absorption generator of claim 1, wherein said generator chamber includes an inclined bottom surface with said tube running substantially parallel thereto.

6. An absorption generator that heats a liquid solution with a heat emitting fluid, thereby creating a higher concentrated fluid and a lower concentrated fluid from said liquid solution, comprising:

a generator chamber being horizontally elongated and extending between an upstream end and a downstream end, and being adapted to convey said liquid solution in a first direction from said upstream end to said downstream end, said generator chamber defining an inlet at said upstream end to receive said liquid solution, defining a first outlet at said downstream end to discharge said higher concentrated fluid from said generator chamber, and defining a second outlet interposed between said upstream end and said downstream end to emit said lower concentrated fluid from said generator chamber;

a fluid inlet chamber at said downstream end of said generator chamber;

a fluid outlet chamber at said upstream end of said generator chamber; and a plurality of tubes extending between said fluid inlet chamber and said fluid outlet chamber and being adapted to convey said heat emitting fluid from said fluid inlet chamber to said fluid outlet chamber in a counter flow do direction relative to said first direction to place said heat emitting fluid in heat exchange relationship with said solution.

7. The absorption generator of claim 6, wherein gravity assists said generator chamber in conveying said solution therethrough.

8. The absorption generator of claim 6, wherein only a portion of said plurality of tubes is submerged in said liquid solution.

9. The absorption generator of claim 8, wherein said plurality of tubes is more deeply submerged in said liquid solution at said upstream end than at said downstream end.

10. The absorption generator of claim 6, wherein said generator chamber includes an inclined bottom surface that is higher at said downstream end than at said upstream end.

11. The absorption generator of claim 6, wherein said plurality of tubes are disposed at an incline with said plurality of tubes being higher at said downstream end of said generator chamber than at said upstream end of said generator chamber.

12. The absorption generator of claim 6, wherein said generator chamber includes an inclined bottom surface with said plurality of tubes running substantially parallel thereto.

13. The absorption generator of claim 6, wherein at least one of said fluid inlet chamber and said fluid outlet chamber includes a tube sheet through which said plurality of tubes extend, wherein said tube sheet is disposed at an incline.

14. The absorption generator of claim 6, wherein said first outlet is adapted to discharge said higher concentrated fluid as a liquid, and said second outlet is adapted to emit said lower concentrated fluid as a vapor.

15. A method of conveying a liquid solution, a vapor, and steam through an absorption chiller that includes a generator and a condenser with said generator extending horizontally from an upstream end to a downstream end, comprising:

conveying said liquid solution from said upstream end to said downstream end;

conveying said vapor to said condenser from an intermediate position between said upstream end and said downstream end; and conveying said steam downhill through a tube from said downstream end to said upstream end.

16. The absorption generator of claim 15, further comprising submersing said tube in said liquid solution deeper at said upstream end than at said downstream end.

17. The absorption generator of claim 15, wherein said generator chamber includes an inclined bottom surface that runs uphill from said upstream end to said downstream end.

18. The absorption generator of claim 15, wherein said generator chamber includes an inclined bottom surface with said tube running substantially parallel thereto.

* * * * *